US008641223B2

(12) United States Patent
Yeh

(10) Patent No.: US 8,641,223 B2
(45) Date of Patent: Feb. 4, 2014

(54) FLASHING SCREWING STRUCTURE

(75) Inventor: Hsueh-Chu Yeh, Tainan (TW)

(73) Assignee: Shih-Hao Wang, Tainan (TW)

( * ) Notice: Subject to any disclaimer, the term of this patent is extended or adjusted under 35 U.S.C. 154(b) by 147 days.

(21) Appl. No.: 13/415,951

(22) Filed: Mar. 9, 2012

(65) Prior Publication Data

US 2013/0235565 A1 Sep. 12, 2013

(51) Int. Cl.
*F21L 4/00* (2006.01)

(52) U.S. Cl.
USPC ..... 362/158; 362/208

(58) Field of Classification Search
USPC ..... 362/157–158, 201–203, 458, 95, 547, 362/253, 206, 362; 439/500, 252, 259, 341, 439/246–248, 261
See application file for complete search history.

(56) References Cited

U.S. PATENT DOCUMENTS

| | | | | |
|---|---|---|---|---|
| 2006/0034073 | A1* | 2/2006 | Uke | 362/157 |
| 2008/0225519 | A1* | 9/2008 | Uke | 362/202 |
| 2011/0235316 | A1* | 9/2011 | Opolka | 362/206 |

* cited by examiner

*Primary Examiner* — Anne Hines
(74) *Attorney, Agent, or Firm* — Alan Kamrath; Kamrath IP Lawfirm, P.A.

(57) ABSTRACT

A flashlight screwing structure, applicable to a flashlight having a non-cylindrical gripping segment and a screwing unit for changing a battery quickly and conveniently, includes: a thread disposed on an inner surface at a rear end of the flashlight; a connecting unit inserted into the rear end of the flashlight and having a hole centrally formed in the connecting unit; and a thread segment extending inward from an outer cover capable of screwing so as to mesh with the internal thread at the rear end of the flashlight. Therefore, changing the battery of the non-cylindrical flashlight entails rotating and withdrawing the outer cover and the connecting unit, changing the battery, restoring the connecting unit to a position thereof, and rotating the outer cover to fix the outer cover to the rear end of the flashlight.

4 Claims, 4 Drawing Sheets

FLASHING SCREWING STRUCTURE

BACKGROUND OF THE INVENTION

1. Field of the Invention

The present invention relates to a flashlight screwing structure, and more particularly, to a non-cylindrical flashlight that features a gripping segment and has a battery changed conveniently, as the flashlight screwing structure comprises a connecting unit inserted into the rear end of the flashlight and having a hole centrally formed, a thread segment extending inward from an outer cover, and an internal thread disposed at the rear end of the flashlight, such that the thread segment and the internal thread mesh with each other to enable the battery of the non-cylindrical flashlight to be changed quickly and conveniently.

2. Description of Related Art

At present, flashlights designed by the industrial sector come in a wide variety of forms. The conventional flashlights are usually of two types, namely flashlights with a cylindrical gripping segment, and flashlights with a non-cylindrical gripping segment (such as a gripping segment with a rectangular cross-section, or a gripping segment with an oval cross-section), for users to choose from as appropriate.

Existing batteries positioned in conventional flashlights always have a round cross-section. As a result, if a manufacturer puts a battery at the rear end of a conventional flashlight with a non-cylindrical gripping segment, the battery will have to be subjected to direction-related and position-related limitation imposed by means of a pressing-type cover. At present, manufacturers always put a battery at the front end of a conventional flashlight, and as a result a user has to change the battery by removing the illumination element from the front end of the flashlight, taking the old battery, and putting a new battery in the flashlight. Accordingly, it is inconvenient to change a battery of conventional flashlights.

BRIEF SUMMARY OF THE INVENTION

The present invention is aimed at enhancing the ease of changing a battery of a non-cylindrical conventional flashlight, by providing a flashlight screwing structure applicable to a flashlight having a non-cylindrical gripping segment. The flashlight screwing structure comprises: a thread disposed on an inner surface at the rear end of the flashlight; a connecting unit inserted into the rear end of the flashlight and having a hole centrally formed in the connecting unit; a thread segment extending inward from an outer cover; and an internal thread disposed at the rear end of the flashlight. Hence, the thread segment and the internal thread mesh with each other to enable the battery of the non-cylindrical flashlight to be changed quickly and conveniently.

The first objective of the present invention is to provide a flashlight screwing structure applicable to a flashlight having a non-cylindrical gripping segment and a screwing unit for changing a battery. The flashlight screwing structure comprises a thread, a connecting unit, flanges, an outer cover, and a soft plug. The thread is disposed on an inner surface at the rear end of the flashlight. The connecting unit is inserted into the rear end of the flashlight, corresponds in shape thereto, and has a hole centrally formed in the connecting unit. Flanges extend from the outer rim of the connecting unit and are spaced apart, such that the outer cover being capable of screwing and having an operating segment can be inserted into the connecting unit. A thread segment that extends inward from the outer cover penetrates the hole at the center of the connecting unit so as to mesh with the internal thread at the rear end of the flashlight. Hence, changing a battery of the non-cylindrical flashlight only entails rotating the outer cover to withdraw it, taking the connecting unit, changing the battery, restoring the connecting unit to its position, and rotating the outer cover to fix it to the rear end of the flashlight. Accordingly, it is convenient to change a battery of the non-cylindrical flashlight.

The second objective of the present invention is to provide a flashlight screwing structure applicable to a flashlight having a non-cylindrical gripping segment and a screwing unit for changing a battery. The flashlight screwing structure comprises a thread, a connecting unit, a receiving space, an outer cover, and an inner rotary lid. The thread is disposed on an inner surface at the rear end of the flashlight. The connecting unit is inserted into the rear end of the flashlight, corresponds in shape thereto, has a receiving space facing outward and concavely disposed at the connecting unit, and has a hole centrally formed in the connecting unit to penetrate the connecting unit. The outer cover is capable of screwing, has an operating segment, and can be inserted into the connecting unit. A post that extends inward from the outer cover and has a plurality of circumferential grooves can be admitted and inserted into a cavity of the inner rotary lid having a thread externally disposed around the inner rotary lid. A screwing element screws the inner rotary lid and the post of the outer cover together and confines the connecting unit to between the outer cover and the inner rotary lid. The external thread of the inner rotary lid meshes with the internal thread of the flashlight. To change a battery of the non-cylindrical flashlight operating in conjunction with the screwing unit, a user rotates the outer cover so as to withdraw the outer cover together with the connecting unit against which the inner rotary lid abuts, changes the battery, rotates the outer cover so as to drive the inner rotary lid to engage with the internal thread of the flashlight and thereby insert the connecting unit into the rear end of the flashlight. Hence, it is convenient to change a battery of the non-cylindrical flashlight.

The third objective of the present invention is to provide a screwing unit screwed to an internal thread at the rear end of a flashlight having a non-cylindrical gripping segment, such that the screwing unit comprises: a preset contact portion of the connecting unit, wherein the connecting unit comes into contact with the inner surface at the rear end of the flashlight via the preset contact portion of the connecting unit; and at least a waterproof ring disposed at the outer cover and the preset contact portion of the connecting unit.

DETAILED DESCRIPTION OF THE EMBODIMENTS OF THE INVENTION

Figure 1:
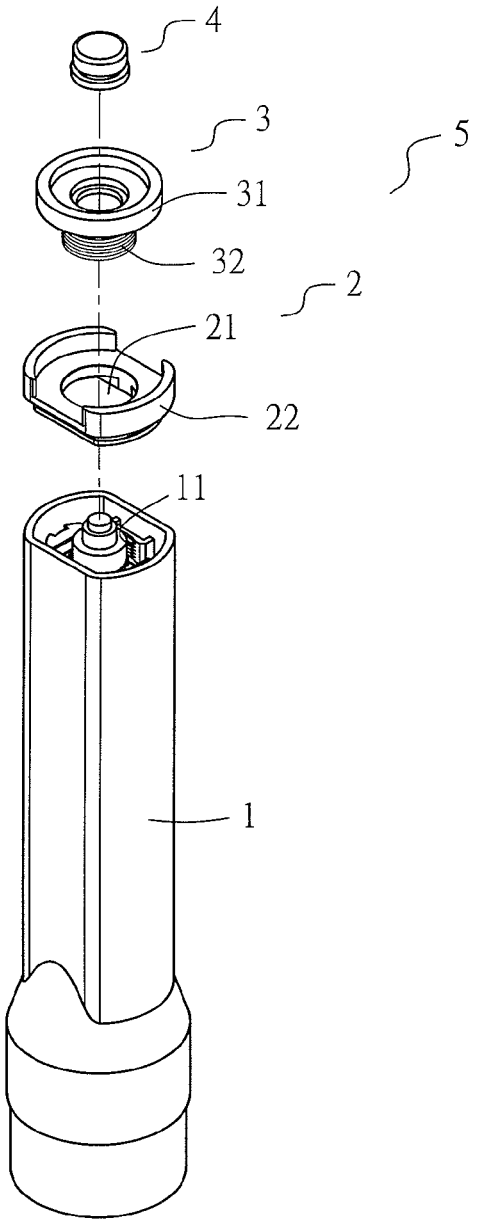
FIG. 1 is an exploded view of a flashlight according to an embodiment of the present invention.
Figure 3:
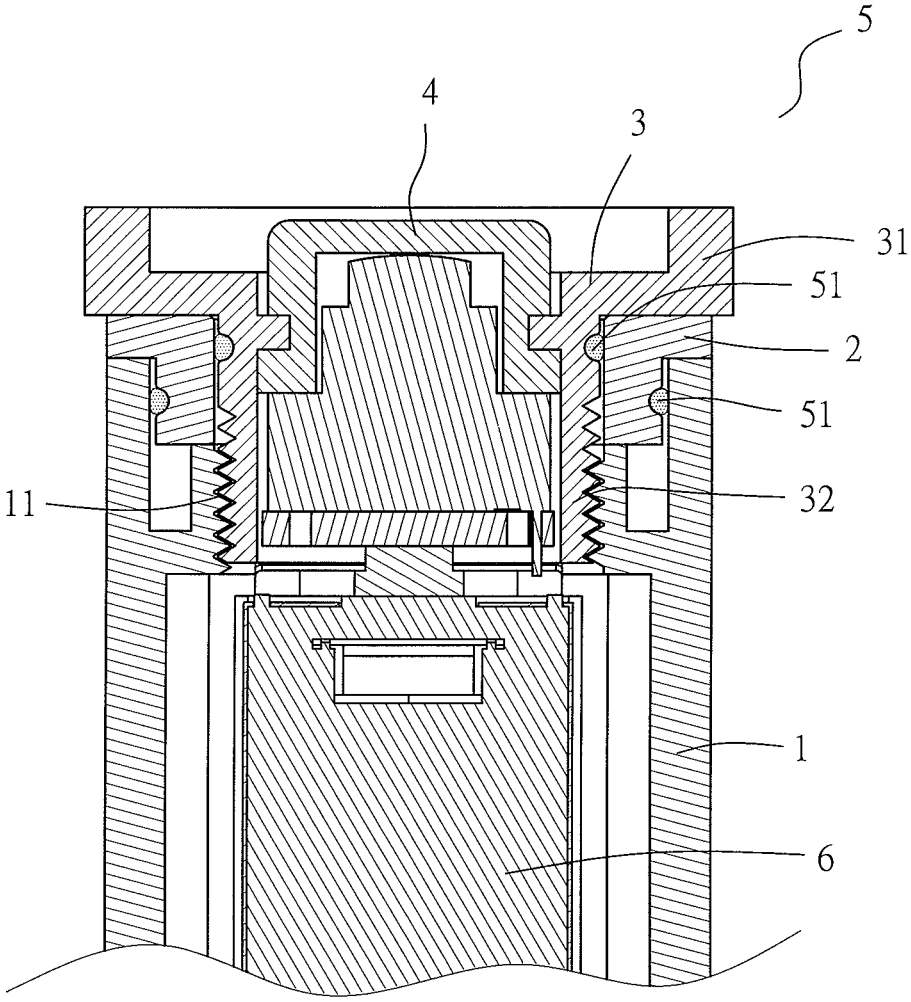
FIG. 3 is a partial cross-sectional view of the flashlight according to an embodiment of the present invention.

Referring to FIG. 1, there is shown an exploded view of a flashlight screwing structure according to an embodiment of the present invention. As shown in FIG. 1, a screwing unit 5 for use in battery replacement operates in conjunction with a flashlight 1 having a non-cylindrical gripping segment. The screwing unit 5 comprises a thread 11, a connecting unit 2, flanges 22, an outer cover 3, and a soft plug 4. Referring to FIG. 1 and FIG. 3, the thread 11 is disposed on the inner surface at the rear end of the flashlight 1. The connecting unit 2 is inserted into the rear end of the flashlight 1, corresponds in shape thereto, and has a hole 21 centrally formed in the connecting unit 2. Flanges 22 extend from the outer rim of the connecting unit 2 and are spaced apart, such that the outer cover 3 being capable of screwing and having an operating segment 31 can be inserted into the connecting unit 2. A thread segment 32 that extends inward from the outer cover 3 penetrates the hole 21 at the center of the connecting unit 2 so as to mesh with the internal thread 11 at the rear end of the flashlight 1, thereby allowing the outer cover 3 to press against the connecting unit 2. The soft plug 4 is centrally disposed in the outer cover 3. Although the soft plug 4 can be adapted to control a power switch of the flashlight 1, the soft plug 4 will be dispensable if the power switch of the flashlight 1 is positioned at the gripping segment of the flashlight 1.

Referring to FIG. 1 and FIG. 3, the screwing unit 5 screwed to the internal thread 11 at the rear end of the flashlight 1 having the non-cylindrical gripping segment comprises: a preset contact portion of the connecting unit 2, wherein the connecting unit 2 comes into contact with the inner surface at the rear end of the flashlight 1 via the preset contact portion of the connecting unit 2; and at least a waterproof ring 51 disposed at the outer cover 3 and the preset contact portion of the connecting unit 2.

Figure 2:
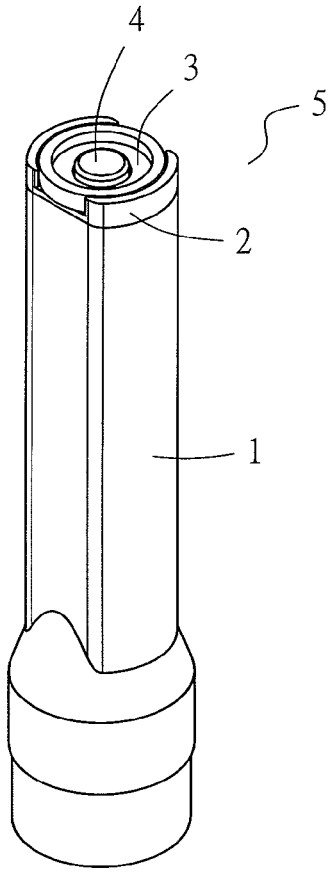
FIG. 2 is a perspective view of the flashlight according to an embodiment of the present invention.

Referring to FIG. 2 and FIG. 3, to change a battery 6 of the non-cylindrical flashlight 1 operating in conjunction with the screwing unit 5, a user rotates the outer cover 3 to withdraw it, takes the connecting unit 2, changes the battery 6, restores the connecting unit 2 to its position, and rotates the outer cover 3 to fix it to the rear end of the flashlight 1. Hence, it is convenient to change a battery of the non-cylindrical flashlight 1.

Figure 4:
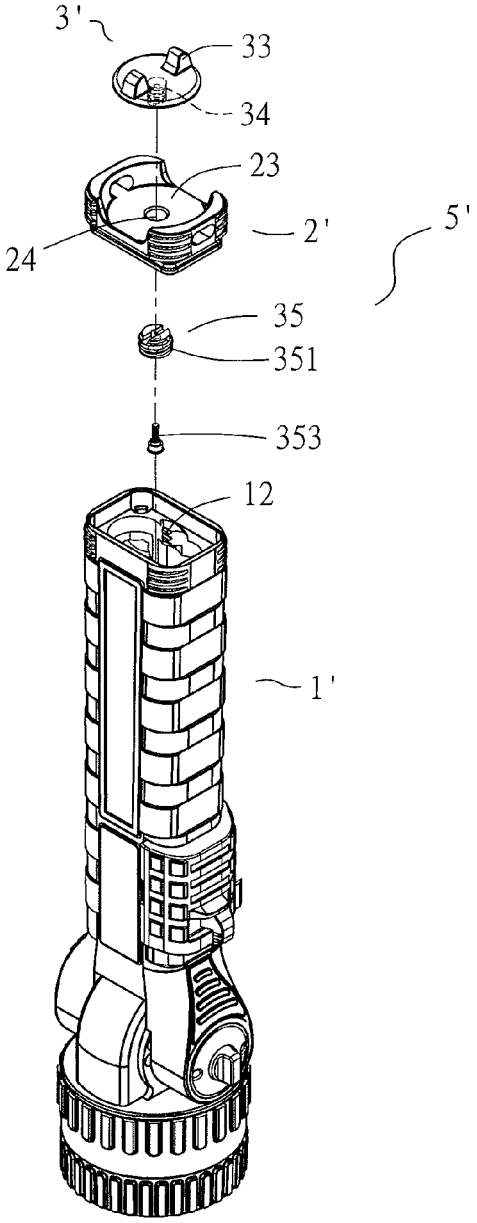
FIG. 4 is an exploded view of the flashlight according to another embodiment of the present invention.
Figure 6:
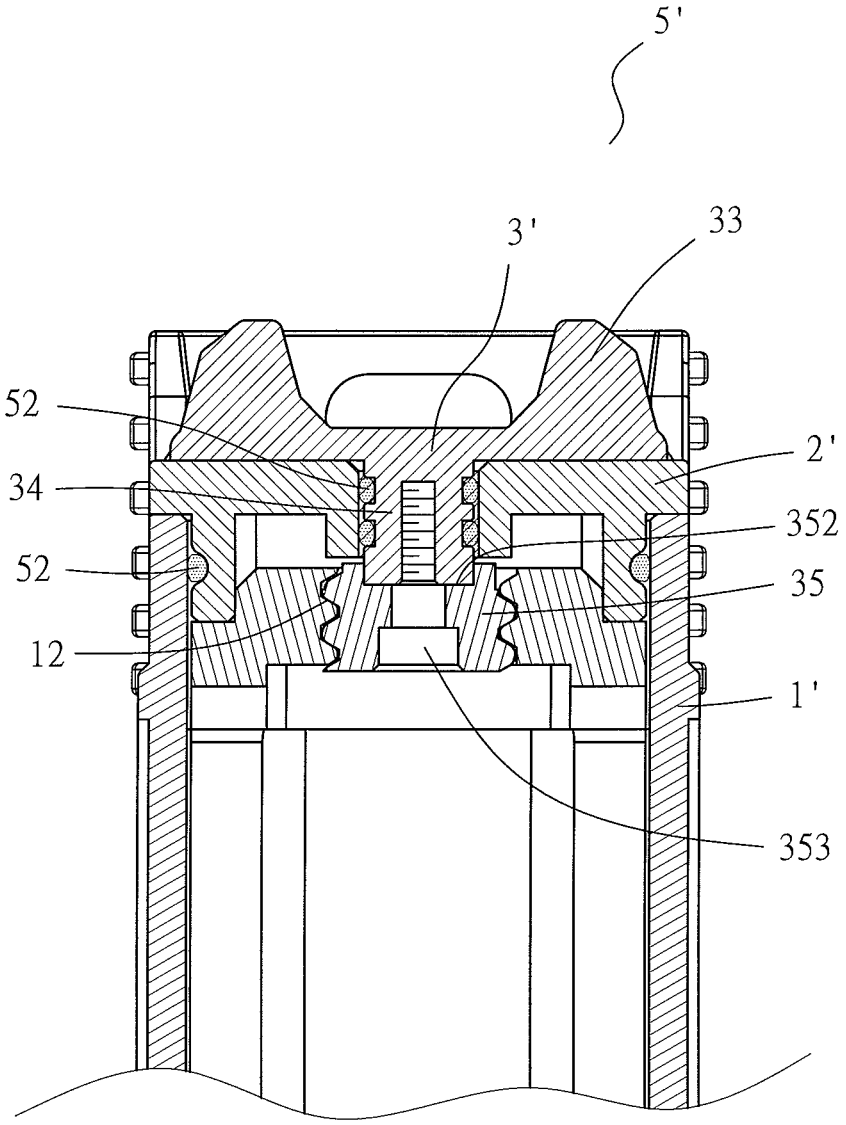
FIG. 6 is a partial cross-sectional view of the flashlight according to another embodiment of the present invention.

Referring to FIG. 4, there is shown is an exploded view of the flashlight screwing structure according to another embodiment of the present invention. As shown in FIG. 4, a screwing unit 5' for use in battery replacement operates in conjunction with a flashlight 1' having a non-cylindrical gripping segment. The screwing unit 5' comprises a thread 12, a connecting unit 2', a receiving space 23, an outer cover 3', and an inner rotary lid 35. Referring to FIG. 4 and FIG. 6, the thread 12 is disposed on the inner surface at the rear end of the flashlight 1'. The connecting unit 2' is inserted into the rear end of the flashlight 1', corresponds in shape thereto, has a receiving space 23 facing outward and concavely disposed at the connecting unit 2', and has a hole 24 centrally formed in the connecting unit 2' to penetrate the connecting unit 2'. The outer cover 3' is capable of screwing, has an operating segment 33, and can be inserted into the connecting unit 2'. A post 34 that extends inward from the outer cover 3' and has a plurality of circumferential grooves can be admitted and inserted into a cavity 352 of the inner rotary lid 35 having a thread 351 externally disposed around the inner rotary lid 35. A screwing element 353 screws the inner rotary lid 35 and the post 34 of the outer cover 3' together and confines the connecting unit 2' to between the outer cover 3' and the inner rotary lid 35. The external thread 351 of the inner rotary lid 35 meshes with the internal thread 12 of the flashlight 1'.

Referring to FIG. 6, the screwing unit 5' screwed to the internal thread 12 at the rear end of the flashlight 1' having the non-cylindrical gripping segment comprises: a preset contact portion of the connecting unit 2', wherein the connecting unit 2' comes into contact with the inner surface at the rear end of the flashlight 1' via the preset contact portion of the connecting unit 2'; and at least a waterproof ring 52 disposed at the outer cover 3' and the preset contact portion of the connecting unit 2'.

Figure 5:
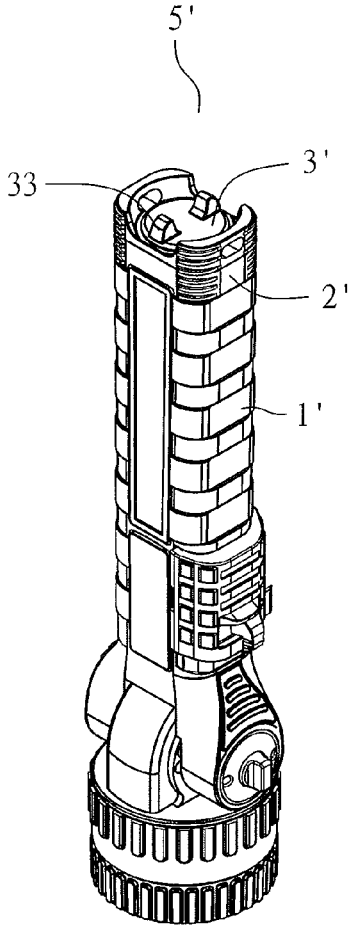
FIG. 5 is a perspective view of the flashlight according to another embodiment of the present invention.

Referring to FIG. 5 and FIG. 6, to change a battery 6 of the non-cylindrical flashlight 1' operating in conjunction with the screwing unit 5', a user rotates the outer cover 3' so as to withdraw the outer cover 3' together with the connecting unit 2' against which the inner rotary lid 35 abuts, changes the battery 6, rotates the outer cover 3' so as to drive the inner rotary lid 35 to engage with the internal thread 12 of the flashlight 1' and thereby insert the connecting unit 2' into the rear end of the flashlight F. Hence, it is convenient to change a battery of the non-cylindrical flashlight 1'.

What is claimed is:

1. A flashlight screwing structure, applicable to a flashlight having a non-cylindrical gripping segment and a screwing unit for changing a battery, the flashlight screwing structure comprising:

a thread disposed on an inner surface at a rear end of the flashlight;

a connecting unit inserted into the rear end of the flashlight, corresponding in shape thereto, and having a hole centrally formed in the connecting unit;

flanges extending from an outer rim of the connecting unit and being spaced apart, such that an outer cover capable of screwing and having an operating segment can be inserted into the connecting unit; and a thread segment extending inward from the outer cover to penetrate the hole at the center of the connecting unit so as to mesh with the internal thread at the rear end of the flashlight, wherein changing a battery of the non-cylindrical flashlight only entails rotating the outer cover to withdraw the outer cover, taking the connecting unit, changing the battery, restoring the connecting unit to a position thereof, and rotating the outer cover to fix the outer cover to the rear end of the flashlight.

2. The flashlight screwing structure of claim 1, wherein the screwing unit screwed to the internal thread at the rear end of the flashlight having the non-cylindrical gripping segment comprises: a preset contact portion of the connecting unit, wherein the connecting unit comes into contact with the inner surface at the rear end of the flashlight via the preset contact portion of the connecting unit; and at least a waterproof ring disposed at the outer cover and the preset contact portion of the connecting unit.

3. A flashlight screwing structure, applicable to a flashlight having a non-cylindrical gripping segment and a screwing unit for changing a battery, the flashlight screwing structure comprising:

a thread disposed on an inner surface at a rear end of the flashlight;

a connecting unit inserted into the rear end of the flashlight, corresponding in shape thereto, having a receiving space facing outward and concavely disposed at the connecting unit, and having a hole centrally formed in the connecting unit to penetrate the connecting unit;

an outer cover capable of screwing, having an operating segment, and being inserted into the connecting unit; and a post extending inward from the outer cover and having a plurality of circumferential grooves so as to be admitted and inserted into a cavity of an inner rotary lid having a thread externally disposed around the inner rotary lid, wherein a screwing element screws the inner rotary lid and the post of the outer cover together and confines the connecting unit to between the outer cover and the inner rotary lid, wherein the external thread of the inner rotary lid meshes with the internal thread of the flashlight, wherein changing the battery of the non-cylindrical flashlight only entails rotating the outer cover so as to withdraw the outer cover together with the connecting unit against which the inner rotary lid abuts, changing the battery, rotating the outer cover so as to drive the inner rotary lid to engage with the internal thread of the flashlight and thereby insert the connecting unit into the rear end of the flashlight.

4. The flashlight screwing structure of claim 3, wherein the screwing unit screwed to the internal thread at the rear end of the flashlight having the non-cylindrical gripping segment comprises: a preset contact portion of the connecting unit, wherein the connecting unit comes into contact with the inner surface at the rear end of the flashlight via the preset contact portion of the connecting unit; and at least a waterproof ring disposed at the outer cover and the preset contact portion of the connecting unit.

* * * * *